US007500347B2

(12) United States Patent
Sanders et al.

(10) Patent No.: US 7,500,347 B2
(45) Date of Patent: Mar. 10, 2009

(54) VARIABLE GEOMETRY COMBUSTOR

(75) Inventors: Noel A Sanders, Derby (GB); Carl C Bourne, Derby (GB); Anthony J Moran, Nuneaton (GB); Paul Fletcher, Rugby (GB); Philip P Walsh, Solihull (GB)

(73) Assignee: Rolls-Royce plc, London (GB)

( * ) Notice: Subject to any disclaimer, the term of this patent is extended or adjusted under 35 U.S.C. 154(b) by 830 days.

(21) Appl. No.: 10/914,072

(22) Filed: Aug. 10, 2004

(65) Prior Publication Data

US 2005/0095542 A1 May 5, 2005

(30) Foreign Application Priority Data

Aug. 16, 2003 (GB) ..... 0319329.9

(51) Int. Cl.
*F02C 7/057* (2006.01)

(52) U.S. Cl. ..... 60/39.23; 60/754; 60/794

(58) Field of Classification Search ..... 60/752, 60/39.23, 794, 748, 737, 754; 137/883, 601.01, 137/599.06; 251/251; 431/351, 352, 188, 431/12

See application file for complete search history.

(56) References Cited

U.S. PATENT DOCUMENTS 2,861,419 A * 11/1958 Hausmann ..... 137/15.2
3,927,520 A 12/1975 Arvin
4,078,377 A 3/1978 Owens
4,171,612 A 10/1979 Zwick
4,255,927 A 3/1981 Johnson
4,288,980 A * 9/1981 Ernst ..... 60/39.23
5,127,626 A * 7/1992 Hilal et al. ..... 251/149.1
5,309,710 A 5/1994 Corr, II
5,664,412 A * 9/1997 Overton ..... 60/39.23

FOREIGN PATENT DOCUMENTS

EP 0 547 808 A 6/1993
EP 1 063 476 A 12/2000
GB 1601218 * 10/1981
JP 58 140 520 AB 8/1983

OTHER PUBLICATIONS

Smith et al; Variable Geometry Fuel Injector For Low Emissions Gas Turbines; The American Society of Mechanical Engineers; Jun. 10, 1999.

* cited by examiner

*Primary Examiner*—Michael Cuff
*Assistant Examiner*—Andrew Nguyen
(74) *Attorney, Agent, or Firm*—W. Warren Taltavull; Manelli Denison & Selter PLLC

(57) ABSTRACT

A variable geometry combustor having a combustor liner that defines at least one dilution port in order to provide air to a dilution zone within the combustor. At least one valve is positioned adjacent the dilution port for controlling the flow of air through the dilution port wherein the valve is settable to maintain one of a plurality of different open configurations.

12 Claims, 6 Drawing Sheets

VARIABLE GEOMETRY COMBUSTOR

FIELD OF THE INVENTION

Embodiments of the present invention relate to a variable geometry combustor. Such a combustor may be used in a gas turbine engine.

BACKGROUND OF THE INVENTION

To achieve low emissions of undesirable combustion products for gas turbine engines, lean premixed combustion systems are used. These systems have a premixing zone for creating a controlled fuel/air mix, a reaction zone for combusting the fuel/air mix and a dilution zone for adding air to the combustion products.

These types of combustion systems are sensitive to the fuel/air ratio produced at the premixing zone. There is an optimum value of flame temperature for low NOx emissions. If the percentage of fuel increases beyond the optimum, then NOx emissions increase as the flame temperature increases. If the percentage of fuel decreases below the optimum then CO emissions increase and the combustor may go out because the flame temperature has fallen too low.

A gas turbine requires varying amounts of fuel depending upon the required output from the engine. It is important that as the fuel required by the engine varies the temperature in the reaction zone remains substantially constant at or near the optimum value. The temperature is controlled by fuel composition, the air: fuel ratio; and the degree of pre-heating of air and fuel prior to combustion. Therefore as more fuel is injected, more air is required in the pre-mixing zone and as less fuel is injected, less air is required in the pre-mixing zone.

There are a number of mechanisms in the prior art for varying the mass flow of air to be mixed with fuel prior to combustion. U.S. Pat. No. 4,255,927 and EP0547808 disclose a combustion system in which the air and fuel are mixed within a combustion chamber, without pre-mixing. An air flow from a compressor to the combustor is divided between the reaction zone of the combustor and the dilution zone of the combustor. An external valve mechanism is used to control the relative proportions of air flowing to the reaction zone and the dilution zone.

"Variable Geometry Fuel Injector for Low Emissions Gas Turbines", by K. Smith et al, Solar Turbines Inc., Aeroengine Society of Mechanical Engineers (ASME) 99-GT-269, discloses a mechanism for varying the air flow to a premixing zone of a fuel injector. This document discloses a lean premixed combustion system in which a variable geometry injector uses a movable air metering plug at an upstream end of the injector to variably control the amount of air entering the pre-mixing zone. A nearly constant peak flame temperature during operation of the engine is maintained by moving the air metering plug. A problem with this type of system is that a change in the fuel injector geometry may result in a change in the total combustor area for fluid input with a consequent change in combustor pressure drop.

U.S. Pat. No. 3,927,520 and U.S. Pat. No. 5,309,710 disclose a variable geometry combustion systems that vary the amounts of air provided to the premixing zone and the dilution zone without varying the combustor area for fluid input.

U.S. Pat. No. 3,927,520 discloses the control of air flow into the dilution zone, by using a first perforated sleeve movable to cover the dilution air ports, and the control of air flow into the pre-chamber, for premixing with fuel, by using a second perforated sleeve movable to cover the air entrance ports. The sleeves operate so that the exposed area of the second entrance ports in the pre-chamber varies in the reverse sense to the exposed area of the dilution air ports.

U.S. Pat. No. 5,309,710 discloses a combustion system that maintains a nearly constant peak flame temperature during operation of the engine cycle by using variable geometry air flow control. A plurality of poppet valves are located adjacent the mixing zone of the combustor chamber. Each poppet valve is in one of two configurations either an open position in which air is directed into the reaction zone or in a closed position in which the air is directed to the dilution zone. A poppet valve therefore directs air to either the mixing zone or the dilution zone. The system is designed so that the open combustor area is the same whether or not a port is open or closed. Thus the open area of the combustor is kept constant. The system is, however, complex because each valve has to be separately actuated.

It would be desirable to provide an alternative combustion system that substantially maintains a desired flame temperature during operation of the engine cycle by using a simpler mechanism for achieving variable geometry air flow control.

SUMMARY OF THE INVENTION

According to one aspect of the present invention there is provided a variable geometry combustor, comprising: a combustor liner defining a plurality of dilution ports for providing air to a dilution zone of the combustor; and a plurality of valves, each valve being positioned adjacent a respective one of the dilution ports for controlling the flow of air through the dilution ports, each valve being settable to maintain one of a plurality of different open configurations, each valve being arranged for reciprocating movement.

The valve can have a multiple number of configurations and therefore provides precise control of the combustor liner flow area in a simple and effective way.

The combustor preferably has a plurality of such valves which are simultaneously actuated to be set to the same position.

According to another aspect of the invention there is provided a method of operating a combustor comprising a premixing fuel injector and a combustor liner, comprising the steps of simultaneously: varying the geometry of the combustor liner; and varying the geometry of the pre-mixing zone, downstream of the fuel inlet of the pre-mixing fuel injector.

BRIEF DESCRIPTION OF THE DRAWINGS

For a better understanding of the present invention, reference will now be made by way of example only to the accompanying drawings in which.

DETAILED DESCRIPTION OF THE INVENTION

Figure 1:
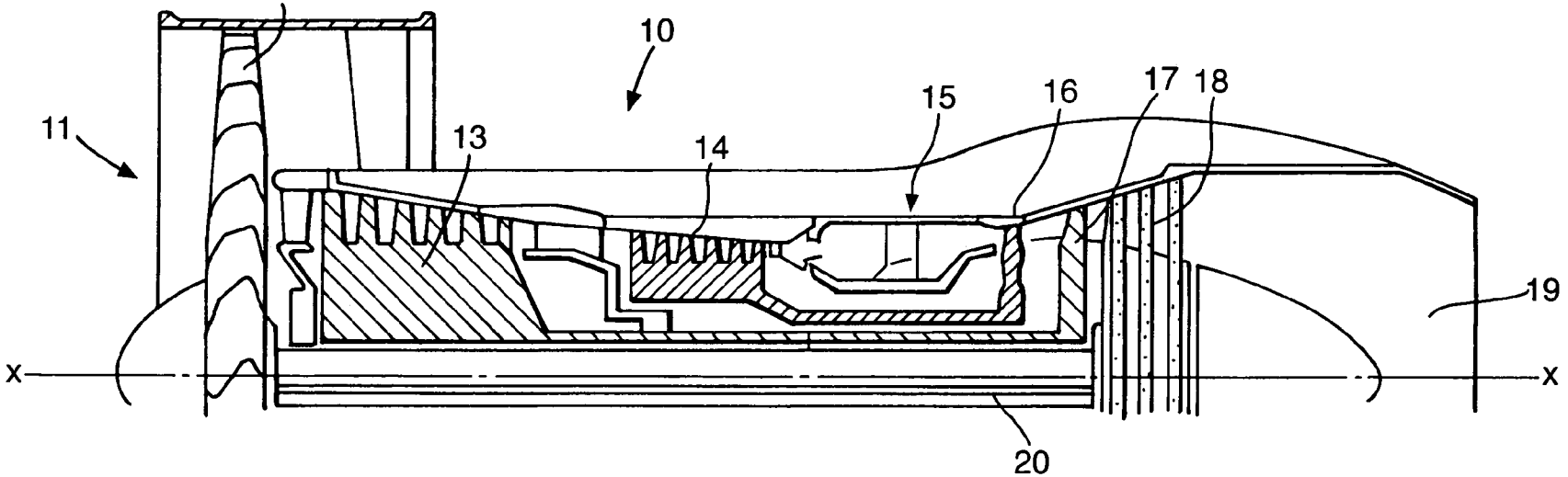
FIG. 1 illustrates a sectional side view of the upper half of a gas turbine engine.

The figures illustrate a variable geometry combustor (15) comprising a combustor liner (42) defining at least one dilution port (86) for providing air to a dilution zone (85) of the combustor (15); and at least one valve (90) positioned adjacent the dilution port (86) for controlling the flow of air through the dilution port (86), the valve (90) being settable to maintain one of a plurality of different open configurations.

The figures also illustrate a variable geometry pre-mixing fuel injector (50) for injecting a fuel/air mix in a downstream direction, comprising: an air inlet (60); a fuel inlet (58) positioned downstream of the air inlet (60); a duct (56) extending at least downstream of the fuel inlet (58) to define a fuel and air pre-mixing zone (62), that narrows to form an opening (64); and means (70) for varying the flow of fuel/air mix from the pre-mixing zone (62) through the opening (64).

FIG. 1 illustrates a sectional side view of the upper half of a gas turbine engine 10. The gas turbine illustrated is for an aero-engine. Embodiments of the invention, however, find particular application in industrial and land-based gas turbine engines.

The illustrated aero gas turbine engine comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18 and an exhaust nozzle 19.

The gas turbine engine 10 operates in a conventional manner so that air entering in the intake 11 is accelerated by the propulsive fan 112 which produces two air flows: a first air flow into the intermediate pressure compressor 13 and a second air flow which provides propulsive thrust. The intermediate pressure compressor 13 compresses air flow directed into it for delivering that air to the high pressure compressor 14 where further compression takes place. The compressed air exhausted from the high pressure compressor 14 is directed into the combustor 15 where it is mixed with fuel and the mixture combusted. The resultant hot combustion products then expand and thereby drive the high, intermediate and low pressure turbines 16, 17, 18 before being exhausted through the nozzle 19 to provide additional propulsive thrust. The high, intermediate and low pressure turbines 16, 17, 18 respectively drive the high and intermediate pressure compressors 14, 13 and the propulsive fan 12 by suitable interconnecting shafts 20.

In an industrial or land-based gas turbine engine, a fan is not provided and the drives a generator, pump etc. and does not provide propulsive thrust.

Figure 2:
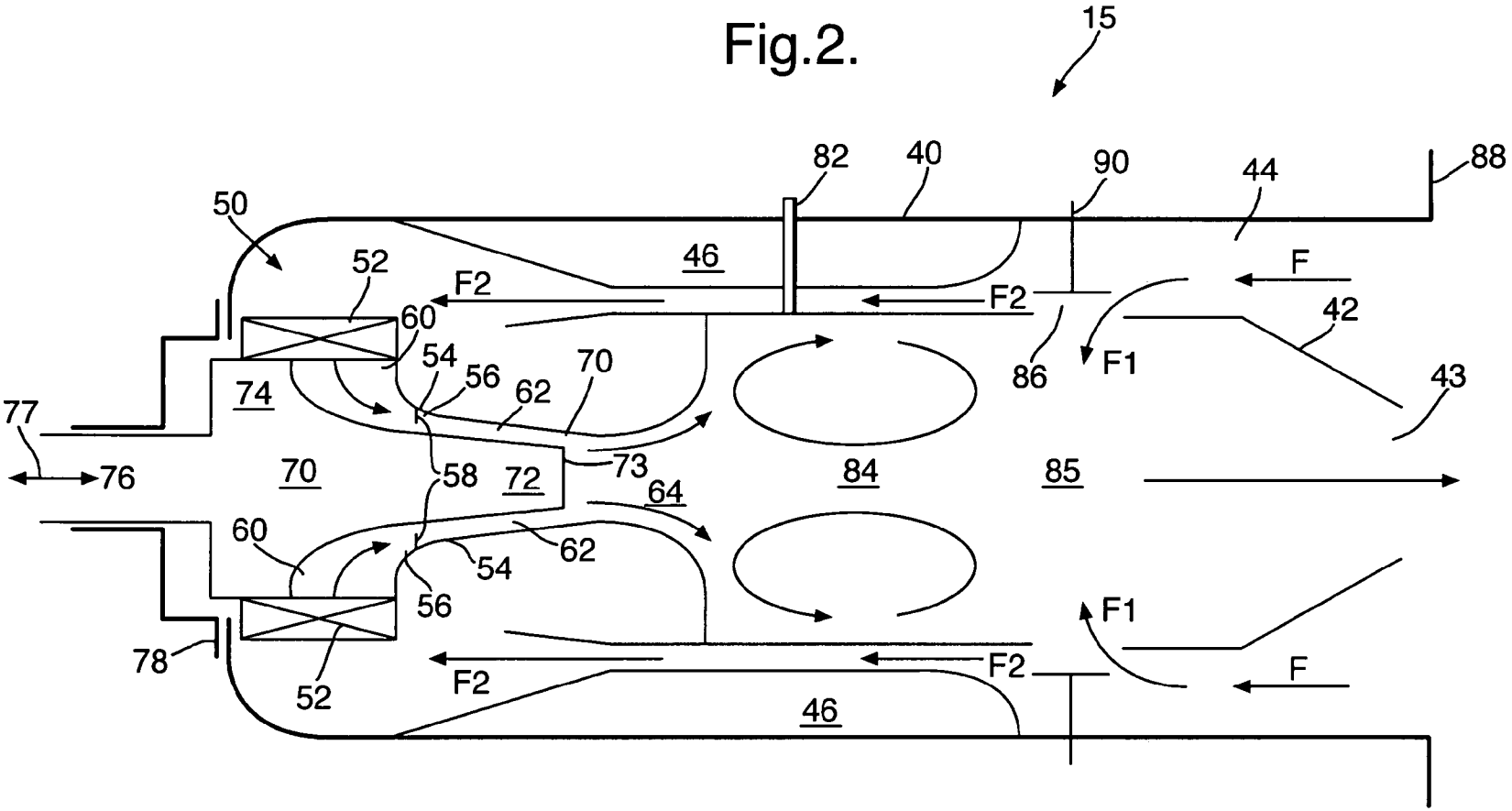
FIG. 2 is a cross-sectional view of a combustor according to one embodiment of the present invention.

In more detail, FIG. 2 illustrates a combustor 15 comprising a combustion chamber defined by a combustion chamber outer casing 40 and a premixing fuel injector 50. The fuel injector 50 is a variable geometry, lean pre-mixing fuel injector. A substantially cylindrical combustor liner 42 is located co-axially within the substantially cylindrical combustion chamber outer casing 40. The space between the combustor liner 42 and the combustion chamber outer casing 40 forms an air conduit 44 which channels air from the compressors of the gas turbine engine. The combustor liner 42 has a plurality of dilution ports 86 which allow air from the air conduit 44 to enter a dilution zone 85 within the combustor liner 42. In this embodiment there are four dilution ports 86, separated equidistantly around the circumference of the cylindrical combustor liner 42, however, other numbers and configurations of dilution ports are possible. Each dilution port 86 has an associated valve 90 adjacent thereto. Each valve 90 is movable to control the amount of air from the air conduit 44 that passes through the associated dilution port 86 into the dilution zone 85. The air flow F from the compressor is therefore separated by the valves 86 into an air flow F1 into the dilution zone 85 and an air flow F2 towards the fuel injector 50. The air conduit 44 comprises fairing 46 which constricts the air conduit 44 and increases the velocity of the air flow F2 in the conduit before it reaches the fuel injector 50.

The air from the air conduit 44 passes through swirlers 52 into an air inlet 60 of an duct 56, which is defined between duct walls 54 and a centre body 70. The swirlers 52 and the duct 56 reverse the direction of the air flow within the duct 56 so that it flows in the opposite direction to that in the air conduit 44. This reverse-flow combustor is therefore able to be aligned off-axis of the gas turbine engine. One or more fuel inlets 58 depend from the duct walls 54 into the duct 56. When fuel is injected from the fuel inlet 58, it mixes with the air arriving through the air inlet 60 in the pre-mixing zone 62 of the fuel injector 50, downstream of the fuel inlets 58, before exiting the fuel injector 50 via an opening 64 into a reaction zone 84 within the combustor liner 42.

The duct 56 is defined on one side by the duct walls 54 which are connected to the combustor liner 42 and on the other side by the exterior surface of a centre body 70. The centre body 70 can be reciprocated, along the axis of the combustor 15, in the direction of the arrows 77 via the actuator 76 to vary the geometry of the duct 56 of the fuel injector 50. The centre body 70 tapers from a cylindrical flange-like portion 74, the outer radial surface of which abuts the swirlers 52, to a smaller radius cylindrical or frusto-conical leading portion 72. The tapering is arcuate in cross-section. The gap between the front of the leading portion 72 and the duct walls 54 define the area 80 (as shown in FIGS. 3*a*-4*d*) of the fuel injector 50 through which the fuel/air mix flows. The reciprocation of the centre body 70 varies the area 80. The area is smaller as the centre body moves to the right and larger as it moves to the left. The reciprocation also varies the extent to which the outer radial surface of the cylindrical flange-like portion 74 covers the swirlers 52. As the centre body 70 moves to the right, the swirlers 52 are more and more obscured.

The area of the air inlet 60 of the fuel injector 50, which is defined between the flange-like portion 74 of the centre body 70 and the duct wall 54 is always greater than the area 80 between the front of the leading portion 72 of the centre body 70 and the duct wall 54. The area of the duct 56 steadily decreases as the air passes from the air inlet 60 past the fuel inlet 58 and through the area 80.

When the fuel/air mix enters the reaction zone 84 within the combustor liner 42 from the pre-mixing zone 62 within the fuel injector 50, it is ignited using an ignitor 82. The fuel/air mix combusts and the combustion products are mixed with air entering the combustor liner 42 via the dilution ports 86 in the dilution zone 85 of the combustor liner 42 before being exhausted via the exit 43 of the combustor liner 42.

The combustion chamber outer casing 40 has a flange 88 which allows its attachment to the turbine housing of the gas turbine engine 10. The centre body 70 of the fuel injector 50 is held in position by a flange 78. The fuel injector 50 can be easily serviced by removing the flange 78 through which the actuator 76 protrudes.

The centre body 70 may have channels within it that allow air to pass through vents 73 in the end of the leading portion 72 of the centre body 70.

Figure 3A:
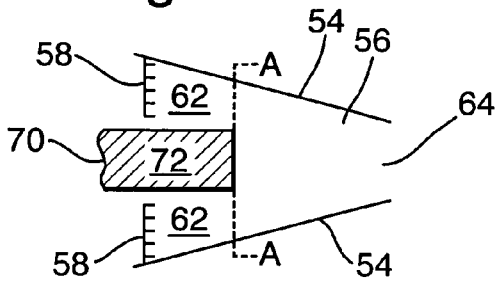
FIGS. 3*a* and 3*c* illustrate a cross-section of an injector according to a first embodiment of the present invention in, respectively, an unthrottled and a throttled configuration.

FIGS. 3*a*, 3*b*, 3*c* and 3*d* illustrate one embodiment of the fuel injector 50. FIG. 3*a* illustrates the portion of the fuel injector 50 downstream of the fuel inlet 58. The duct walls 54 form a frusto-conical shape, the side walls 54 of which converge from the fuel inlet 58 towards the opening 64. The centre body 70 has a cylindrically shaped leading portion 72.

Figure 3B:
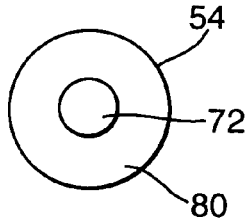
FIGS. 3*b* and 3*d* illustrate cross-sectional views of the fuel injectors illustrated in FIGS. 3*a* and 3*c* respectively, along the respective lines A-A and B-B.

In FIG. 3*a*, the cylindrical centre body 70 is in a non-throttled configuration. The centre body 70 is in a retracted position such that the area 80 is large. FIG. 3*b*, which is a section along the line A-A in FIG. 3*a*, illustrates the area 80.

Figure 3C:
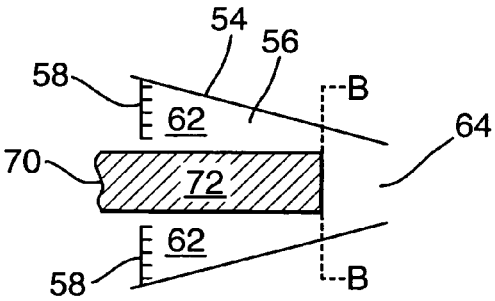
Figure 3D:
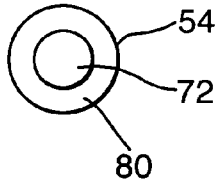

In FIG. 3*c*, the same cylindrical centre body 70 is now in a throttled configuration. The cylindrical centre body 70 is in a fully inserted position such that the area is small. FIG. 3*d*, which is a section along the line B-B of FIG. 3*c*, illustrates the area 80.

Figure 4A:
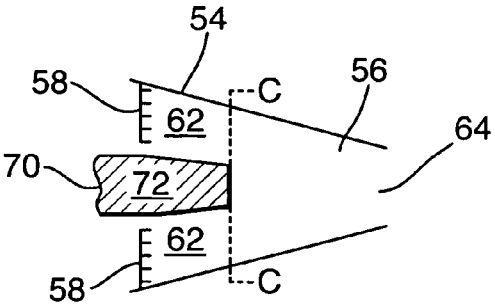
FIGS. 4*a* and 4*c* illustrate a cross-section of a fuel injector according to a second embodiment in, respectively, an unthrottled and a throttled configuration.

FIGS. 4*a*, 4*b*, 4*c* and 4*d* illustrate another embodiment of the fuel injector 50. FIG. 4*a* illustrates the portion of the fuel injector 50 downstream of the fuel inlet 58. The duct walls 54 form a frusto-conical shape, the side walls 54 of which converge from the fuel inlet 58 towards the opening 64. The centre body 70 has a frusto-conical shaped leading portion 72. The angle for the apex defining the frusto-conical leading portion 72 is less than the angle of the apex defining the frusto-conical duct walls 54. Thus, the duct walls converge more quickly than the outer surfaces of the frusto-conical leading portion 72 of the centre body 70.

Figure 4B:
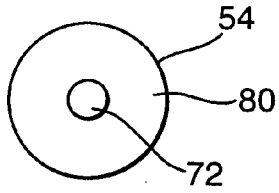
FIGS. 4*b* and 4*d* illustrate cross-sectional views of the fuel injectors illustrated in FIGS. 4*a* and 4*c* respectively, along respective lines C-C and D-D.

In FIG. 4*a*, the frusto-conical centre body 70 is in a non-throttled configuration. The centre body 70 is in a retracted position such that the area 80 is large. FIG. 4*b*, which is a section along the line C-C in FIG. 4*a*, illustrates the area 80.

Figure 4C:
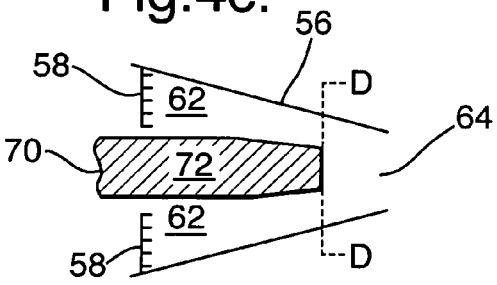
Figure 4D:
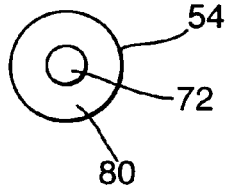

In FIG. 4*c*, the same frusto-conical centre body 70 is now in a throttled configuration. The centre body 70 is in a fully inserted position such that the area 80 is small. FIG. 4*d*, which is a section along the line D-D of FIG. 4*c*, illustrates the area 80.

The duct 56, defined between on one side by duct walls 54 and on the other side by the exterior surface of a centre body 70, narrows from the location of the fuel inlet 58 to the end of the centre body 70 defining the area 80. This is a common feature in both embodiments of the fuel injector 50 and it maintains the velocity of the fuel/air mix above the flame velocity as the geometry of the fuel injector 50 varies. This prevents flashback.

Figure 5:
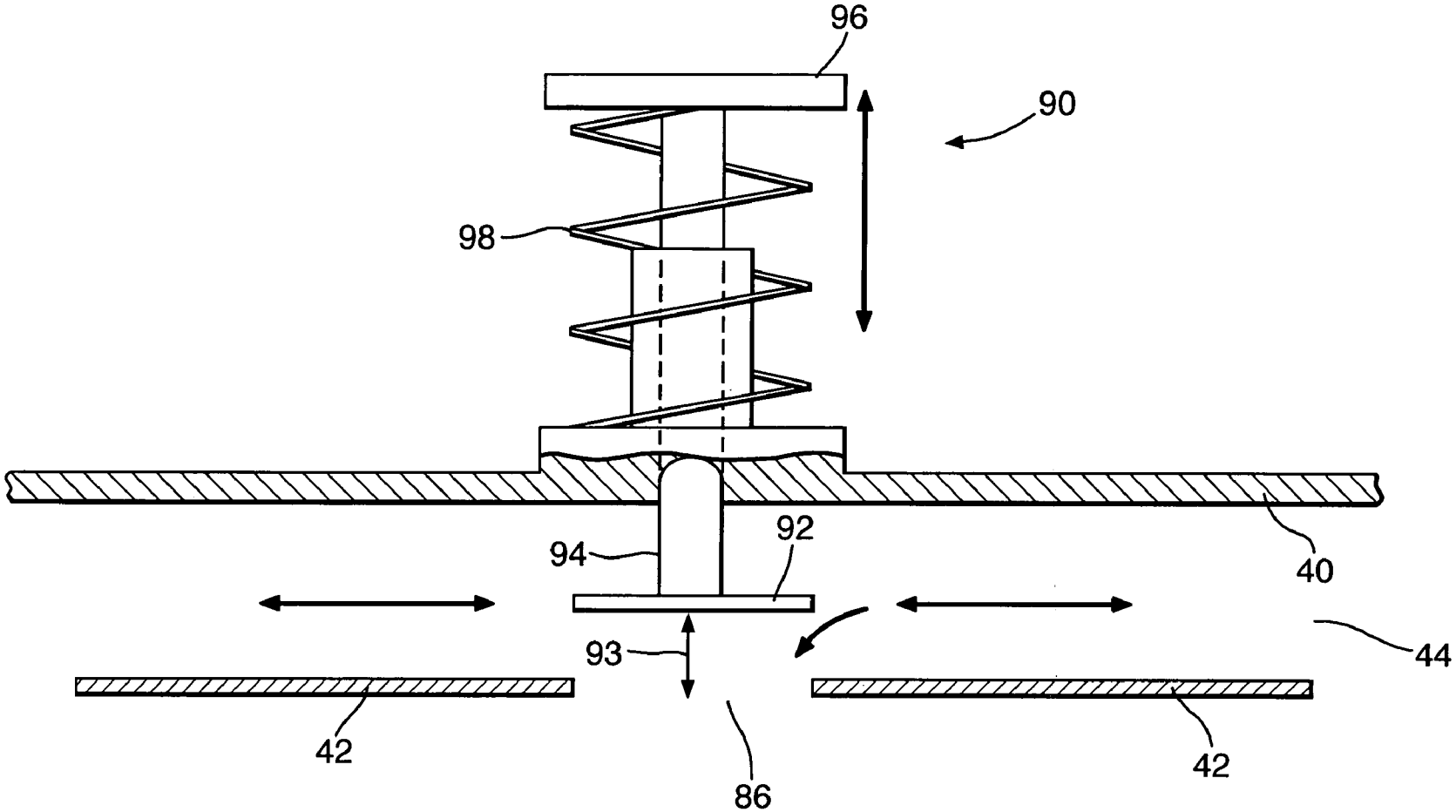
FIG. 5 illustrates, in more detail, one of the valves used to vary the geometry of the combustor liner.

FIG. 5 illustrates, in more detail, the valve 90, which is used to control the proportion of the flow of air F along the air conduit 44 which should enter the dilution zone 85 via the dilution port 86. The valve 90 has a head 92 which is substantially the same size and shape as the dilution port 86. The head 92 is connected to a stem 94 which passes through the combustion chamber outer casing 40 and is connected to a collet 96 at the other end. A spring 98 is positioned between the collet 96 and the combustion chamber outer casing 40 and it biases the valve so that the head 92 is retracted away from the dilution port 86 to the maximum possible extent. The stem 94 moves freely through the hole in the combustion chamber outer casing 40 and therefore allows the head 92 of the valve to take up multiple positions within the air conduit 44. The effectiveness of the valve 90 in directing the flow of air through the air conduit 44 into the dilution zone 85 via the dilution port 86 depends upon the spacing 93 between the combustor liner 42 and the valve head 92. The valve 90 is controlled in an analogue manner so that it can be set in any one of a plurality of different positions and thus provide for any desired duration at any one of a plurality of spacings 93.

The valve 90 is optionally arranged so that there is always some element of spacing 93 between the valve head 92 and the combustor liner 42. That is the valve 90 only has open configurations and has no closed configuration in which the dilution port 86 is closed by the head 92.

Figure 6:
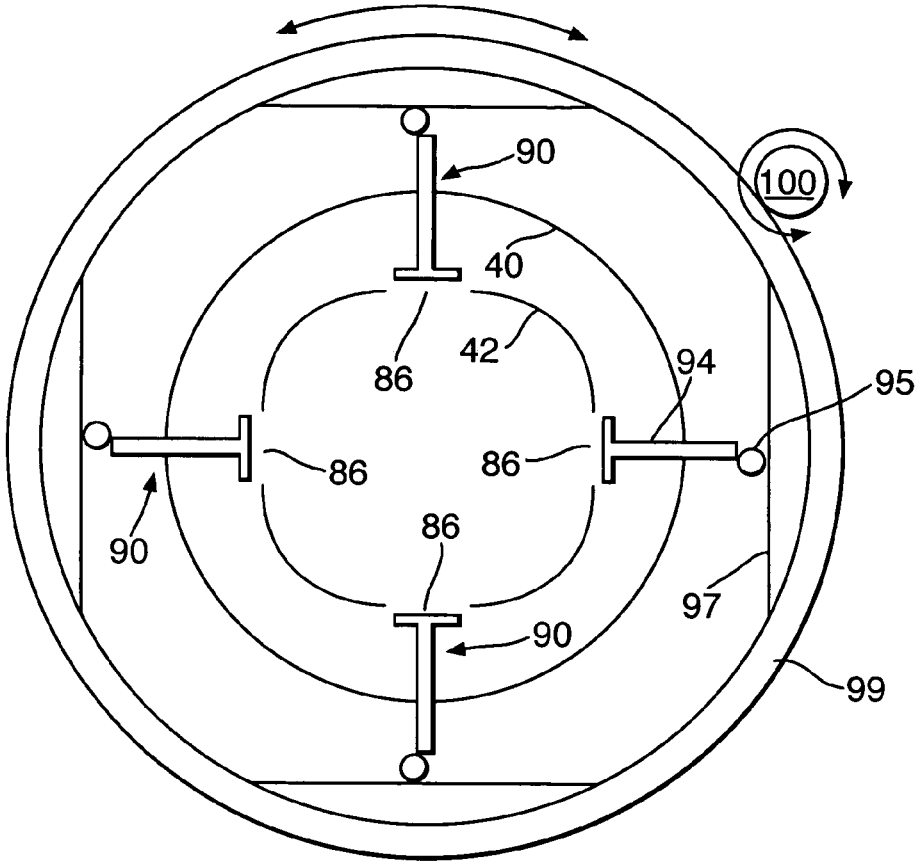
FIG. 6 illustrates one mechanism for actuating the valves to alter the geometry of the combustor liner.

FIG. 6 illustrates one mechanism for controlling the position of the valves 90 associated with the dilution ports 86. In this example, the dilution ports 86 are symmetrically positioned about the cylindrical combustor liner 42. In this embodiment, the collet 96 of each valve 90 is connected to a roller 95 which operates as a cam follower. Each roller 95 rests on a camming surface 97 which is supported by an actuation ring 99 inscribing the cylindrical combustor liner 42. The actuation ring 99 is rotated by a motor 100 which can rotate and hold the actuation ring 99 at any desired position thus setting the valves 90 to a particular position. As the actuation ring 99 rotates, the roller 95 rolls on the camming surface 97. As the distance between the dilution port 86 and the camming surface 97 increases, the bias produced by the spring 98 moves the valve head 92 so that the spacing 93 increases. As the camming surface 97 moves towards the dilution port 86 the valve head 92 is moved to produce the spacing 93 against the bias produced by the spring 98.

Figure 7:
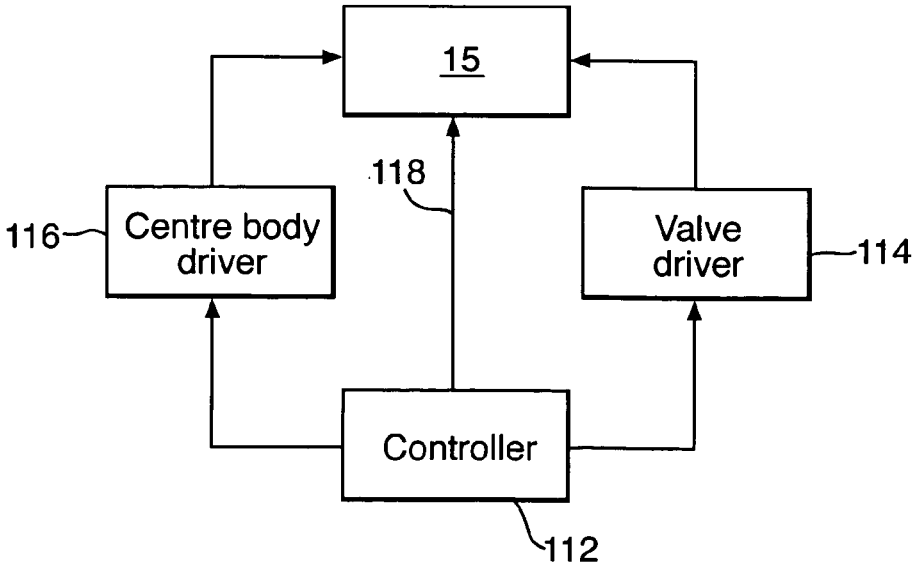
FIG. 7 illustrates a combustion system 110 for controlling simultaneously the position of a centre body and one or more valves.

FIG. 7 illustrates a combustion system 110 for controlling simultaneously the position of a centre body and one or more valves. The combustion system 110 comprises a combustor 15, a centre body driver 116, a controller 112 and a valve driver 114. The controller 112 controls the centre body driver 116 to control the position of the centre body 70 within the fuel injector 50. The controller 112 controls the valve driver 114 to control the positions of the valves 90. The controller 112 also provides a signal 118 which controls the amount of fuel released by the fuel inlets 58.

The controller 112 controls the fuel/air mix at the injector 50 and the air entering via the dilution ports 86 into the dilution zone 85. The controller 112 controls the amount of fuel entering the injector 50 via the fuel inlet 58 and the amount of air entering the air inlet 60 of the fuel injector 50 to achieve the desired power output from the gas turbine engine while maintaining the optimum fuel/air ratio in the pre-mixing zone 62 to control emissions. The desired quantity of fuel is injected into the pre-mixing zone 62 by the fuel inlet 58 under control of signal 118.

The valve driver 114 operates to move the valve heads 92 away from or towards the combustor liner 42 to obtain the correct fuel/air mix in the pre-mixing zone and the centre body driver 116 simultaneously moves the centre body 70 further into or further out of the fuel duct 56 to vary the area 80 and maintain the total input area to the combustor liner constant. The controller 112 thus ensures that the optimum fuel/air mix is provided over a large operating range of the gas turbine engine and pressure variations within the combustor liner 42 are avoided. The injector design reduces the risks of flashback.

Figure 8:
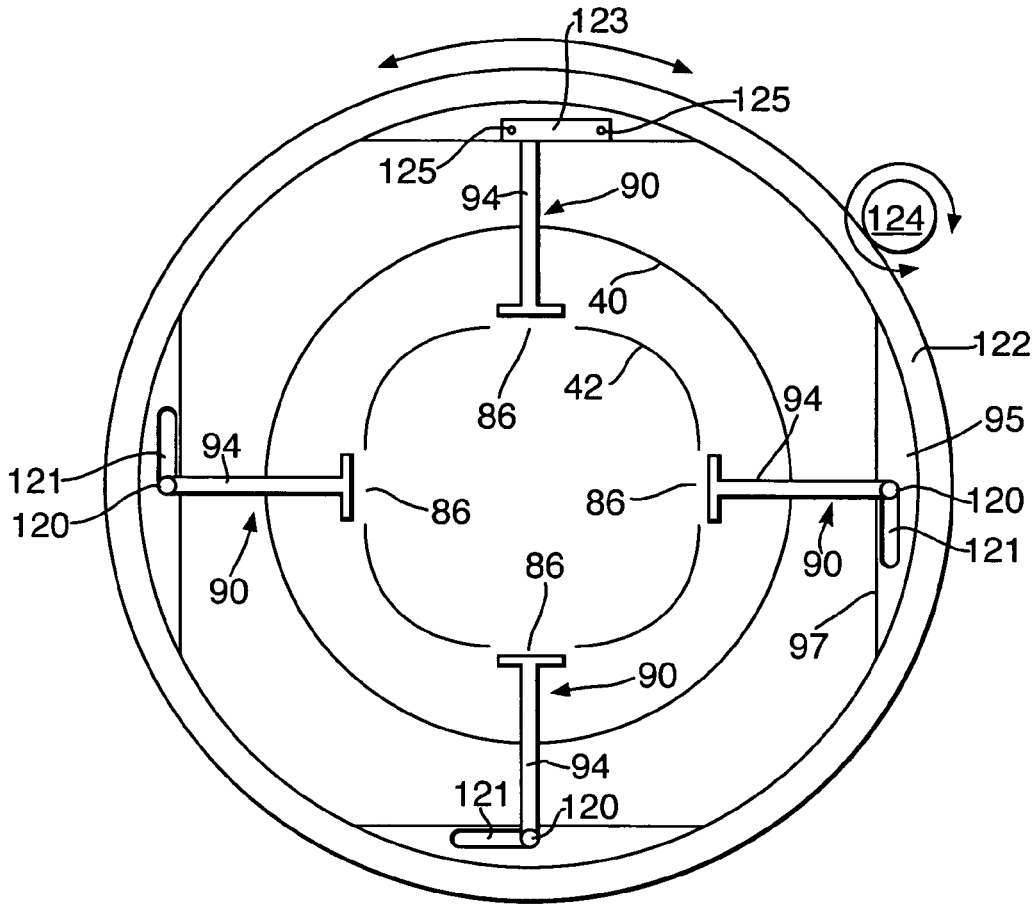
FIG. 8 illustrates an alternative mechanism for actuating the valves to alter the geometry of the combustor liner.

FIG. 8 illustrates another mechanism for controlling the position of the valves 90 associated with the dilution ports 86. In this example, the dilution ports are symmetrically positioned about the cylindrical combustor liner 42. In this embodiment, the stem 94 passes through the combustion chamber outer casing 40 and the collet 96 of each valve 90 is connected to a pin, or peg, 120 which operates as a cam follower. Each peg 120 locates in a respective one of a number of slots 121 in an actuating ring 122 arranged coaxially with and surrounding the combustion chamber outer casing 40.

Each slot 121 is arranged to extend perpendicularly to a line extending radially from the axis of the actuating ring 122. Each peg 120 is held in the respective slot 121 by a respective plate 123, which is secured to the actuating ring 122 by fasteners 125. As the actuation ring 122 is rotated by a motor 124 which can rotate and hold the actuation ring 122 at any desired position thus setting the valves 90 to a particular position. As the actuation ring 122 rotates, the pegs 120 move along the slots 121. As the distance between the dilution port 86 and the slots 121 increases, the pegs 120 move the valve heads 92 radially relative to the actuation ring 122 and cylindrical combustion liner 42 so that the spacing 93 increases. As the slots 121 move towards the dilution port 86 the valve heads 92 are moved radially to reduce the spacing 93. Thus, the springs 98 are not required, but the springs could be used to prevent closure of the valve head 92 if the mechanism fails.

Alternatively each valve 90 may be moved radially by a respective one of a number of linear actuators, which are mounted on the combustion chamber outer casing 40.

According to a variation on the embodiment described in relation to FIG. 7, the combustor 15 has a pyrometer in the reaction zone 84 for measuring the temperature of the combustion products. The output of the pyrometer is provided to the controller 112 which then controls the valve driver 114 and the centre body driver 116 to obtain the desired temperature in the reaction zone 84 and hence power output from the gas turbine engine. The controller 112 operates the valve driver 114 and the centre body driver 116 so that the total open area to the combustor liner remains constant.

In another variation on the embodiment described in relation to FIG. 7, the combustor 15 has a thermocouple and a pressure transducer arranged between the high pressure compressor 14 and the combustor 15 to measure the air temperature and pressure at the entry to the combustor 15. A speed sensor is also provided to measure turbine rotor speed. The measures of air temperature, air pressure and turbine rotor speed are used with power output measurement and ambient temperature measurement by the controller 112 to calculate the mass flow of air through the gas turbine engine 10. The fuel flow rates are also measured. The controller 112 calculates the fuel to air ratio at the exit of the combustor 15 from the air temperature and air pressure at entry to the combustor 15 and the mass flow of air and knowing the percentage of air bled away for cooling of turbine components etc. The controller 112 then calculates the temperature of the gases at the exit of the combustor 15 from the fuel to air ratio at the exit of the combustor 15 using the chemical composition of the fuel and the calorific value of the fuel using an enthalpy balance technique. The controller 112 calculates the air to fuel ratio at which the fuel injector 50 should be operated using the air temperature at the entry to the combustor 15 and the temperature range over which both low NOx and CO emissions are obtained using the enthalpy balance technique. The controller 112 divides the fuel injector air to fuel ratio by the total combustor air to fuel ratio to determine the total amount of air required for the fuel injector 50. The controller 112 then determines the flow area required for fuel injector 50 and the valves 90. The controller 112 then moves the valve driver 114 and the centre body driver 116 to move the valves 90 and centre body 70 to different positions to give low Nox and Co emissions at different operating conditions.

Embodiments of the invention are particularly useful in combustion systems in which the flow area of the injector is more than a small percentage of the total combustor flow area.

Although embodiments of the present invention have been described in the preceding paragraphs with reference to various examples, it should be appreciated that modifications to the examples given can be made without departing from the scope of the invention as claimed.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A gas turbine variable geometry combustor, comprising: a combustor liner defining a plurality of dilution ports for providing air to a dilution zone of the gas turbine combustor; and a plurality of valves, each valve being positioned adjacent a respective one of the dilution ports for controlling the flow of air through the dilution ports, each valve being settable to maintain one of a plurality of different open configurations, each valve being arranged for reciprocating movement and said combustor further comprising control means for variably controlling the setting of the valves wherein the control means comprises a rotatable actuating ring, the actuating ring has a plurality of camming surfaces and each valve has a cam follower arranged to rest on a respective one of the plurality of camming surfaces.

2. A gas turbine variable geometry combustor as claimed in claim 1 wherein each valve has a spring to bias the valve away from the respective dilution port and to bias the cam follower into contact with the camming surface.

3. A gas turbine variable geometry combustor as claimed in claim 2 wherein the cam follower of each valve is a roller.

4. A gas turbine variable geometry combustor as claimed in claim 1 wherein each camming surface comprises a slot in the actuating ring and each valve has a cam follower arranged to locate on a respective one of the plurality of camming surfaces.

5. A gas turbine variable geometry combustor as claimed in claim 2 wherein the cam follower of each valve is a peg.

6. A gas turbine variable geometry combustor as claimed in claim 5 wherein the peg is held in the respective slot.

7. A gas turbine variable geometry combustor as claimed in claim 1 wherein the combustor liner is cylindrical, the dilution ports are circumferentially spaced around the combustor liner and each valve is arranged for radial reciprocating movement.

8. A gas turbine variable geometry combustor as claimed in claim 1, wherein each of the different open configurations of the valve has an associated different air flow through the dilution port.

9. A gas turbine variable geometry combustor as claimed in claim 1, wherein the valve has only open configurations.

10. A gas turbine variable geometry combustor as claimed in claim 1, further comprising an air conduit for directing air over the dilution ports to a fuel injector of the combustor, wherein the valves are positioned within the air conduit for controlling the flow of air through the dilution port.

11. A gas turbine variable geometry combustor as claimed in claim 1, further comprising a variable geometry pre-mixing fuel injector, and means for varying the geometry of the pre-mixing zone, downstream of a fuel inlet, of the pre-mixing fuel injector.

12. A gas turbine variable geometry combustor as claimed in claim 1 wherein the control means further comprises a plurality of linear actuators, each linear actuator is arranged to move a respective one of the valves.

* * * * *